US008988011B2

(12) United States Patent
Dunn

(10) Patent No.: US 8,988,011 B2
(45) Date of Patent: Mar. 24, 2015

(54) SYSTEM AND METHOD FOR MANAGING BACKLIGHT LUMINANCE VARIATIONS

(75) Inventor: William Dunn, Alpharetta, GA (US)

(73) Assignee: Manufacturing Resources International, Inc., Alpharetta, GA (US)

( * ) Notice: Subject to any disclaimer, the term of this patent is extended or adjusted under 35 U.S.C. 154(b) by 1142 days.

(21) Appl. No.: 12/954,134

(22) Filed: Nov. 24, 2010

(65) Prior Publication Data

US 2011/0163691 A1 Jul. 7, 2011

Related U.S. Application Data

(63) Continuation-in-part of application No. 12/124,741, filed on May 21, 2008, now Pat. No. 8,125,163, and a continuation-in-part of application No. 12/711,600, filed on Feb. 24, 2010, now Pat. No. 8,569,910.

(60) Provisional application No. 61/310,143, filed on Mar. 3, 2010, provisional application No. 61/154,936, filed on Feb. 24, 2009.

(51) Int. Cl.

| | |
|---|---|
| ***H05B 37/02*** | (2006.01) |
| ***H05B 33/08*** | (2006.01) |
| ***G09G 3/34*** | (2006.01) |

(52) U.S. Cl.

CPC ..... *H05B 33/0872* (2013.01); *G09G 3/3426* (2013.01); *G09G 2320/0233* (2013.01); *G09G 2320/041* (2013.01); *G09G 2330/021* (2013.01)

USPC ..... 315/309; 315/294; 315/308; 345/102

(58) Field of Classification Search

USPC ..... 315/149, 158, 159, 224, 291, 307–309, 315/312

See application file for complete search history.

(56) References Cited

U.S. PATENT DOCUMENTS

| | | | |
|---|---|---|---|
| 4,093,355 | A | 6/1978 | Kaplit et al. |
| 4,593,978 | A | 6/1986 | Mourey et al. |
| 4,634,225 | A | 1/1987 | Haim et al. |
| 5,029,982 | A | 7/1991 | Nash |
| 5,088,806 | A | 2/1992 | McCartney et al. |

(Continued)

FOREIGN PATENT DOCUMENTS

| | | |
|---|---|---|
| GB | 2402205 | 1/2004 |
| JP | 03153212 | 7/1991 |

(Continued)

OTHER PUBLICATIONS

Zeef, Hubing, EMC analysis of 18' LCD Monitor, Aug. 2000, 1 page.

*Primary Examiner* — Douglas W Owens
*Assistant Examiner* — Amy Yang
(74) *Attorney, Agent, or Firm* — Standley Law Group LLP

(57) ABSTRACT

An LED assembly containing separately-controllable regions of LEDs with temperature sensing devices placed to measure the temperature within each region of LEDs. When the temperature difference between two regions becomes higher than an acceptable maximum, the system may adjust the power to one or more LED regions to maintain luminance uniformity. The regions can be arranged vertically or horizontally or both. A software processor may be used to interpret the data from the temperature sensing devices and control the power sent to the various LED regions. Embodiments can be used at least in LED backlights for LCD displays or for LED displays.

19 Claims, 6 Drawing Sheets

(56) References Cited

U.S. PATENT DOCUMENTS

| | | | | |
|---|---|---|---|---|
| 5,247,374 | A | 9/1993 | Terada | |
| 5,559,614 | A | 9/1996 | Urbish et al. | |
| 5,748,269 | A | 5/1998 | Harris et al. | |
| 5,767,489 | A | 6/1998 | Ferrier | |
| 5,783,909 | A * | 7/1998 | Hochstein | 315/159 |
| 5,818,010 | A | 10/1998 | McCann | |
| 5,991,153 | A | 11/1999 | Heady et al. | |
| 6,089,751 | A | 7/2000 | Conover et al. | |
| 6,153,985 | A * | 11/2000 | Grossman | 315/291 |
| 6,157,432 | A | 12/2000 | Helbing | |
| 6,191,839 | B1 | 2/2001 | Briley | |
| 6,417,900 | B1 | 7/2002 | Shin et al. | |
| 6,535,266 | B1 | 3/2003 | Nemeth et al. | |
| 6,628,355 | B1 | 9/2003 | Takahara | |
| 6,839,104 | B2 | 1/2005 | Taniguchi et al. | |
| 6,885,412 | B2 | 4/2005 | Ohnishi et al. | |
| 6,943,768 | B2 | 9/2005 | Cavanaugh et al. | |
| 7,284,874 | B2 | 10/2007 | Jeong et al. | |
| 7,330,002 | B2 | 2/2008 | Joung | |
| 7,474,294 | B2 | 1/2009 | Leo et al. | |
| 7,795,821 | B2 | 9/2010 | Jun | |
| 7,804,477 | B2 * | 9/2010 | Sawada et al. | 345/101 |
| 8,111,371 | B2 * | 2/2012 | Suminoe et al. | 349/161 |
| 2002/0101553 | A1 | 8/2002 | Enomoto et al. | |
| 2002/0126248 | A1 | 9/2002 | Yoshida | |
| 2003/0007109 | A1 | 1/2003 | Park | |
| 2003/0230991 | A1 | 12/2003 | Muthu et al. | |
| 2004/0036834 | A1 | 2/2004 | Ohnishi et al. | |
| 2004/0165139 | A1 | 8/2004 | Anderson et al. | |
| 2006/0022616 | A1 * | 2/2006 | Furukawa et al. | 315/309 |
| 2006/0082271 | A1 | 4/2006 | Lee et al. | |
| 2007/0297163 | A1 | 12/2007 | Kim et al. | |
| 2009/0033612 | A1 | 2/2009 | Roberts et al. | |
| 2009/0104989 | A1 | 4/2009 | Williams et al. | |
| 2012/0075362 | A1 * | 3/2012 | Ichioka et al. | 345/690 |

FOREIGN PATENT DOCUMENTS

| | | |
|---|---|---|
| JP | 11160727 | 6/1999 |
| JP | 2006145890 | 6/2006 |
| JP | 200803481 | 2/2008 |
| KR | 1020080000144 | 1/2008 |
| KR | 1020080013592 | 2/2008 |
| KR | 1020080086245 | 9/2008 |
| WO | WO2005079129 | 8/2005 |

* cited by examiner

SYSTEM AND METHOD FOR MANAGING BACKLIGHT LUMINANCE VARIATIONS

CROSS-REFERENCE TO RELATED APPLICATIONS

This application is a non-provisional of U.S. Application No. 61/310,143 filed Mar. 3, 2010 and is hereby incorporated by reference as if fully cited herein. This application is a continuation in part of U.S. application Ser. No. 12/711,600 filed Feb. 24, 2010 which is a non-provisional of U.S. Application No. 61/154,936 filed Feb. 24, 2009 each of which are hereby incorporated by references as if fully cited herein. This application is a continuation in part of U.S. application Ser. No. 12/124,741 filed May 21, 2008 and is hereby incorporated by reference as if fully cited herein.

TECHNICAL FIELD

Exemplary embodiments generally relate to cooling systems and in particular to cooling systems for electronic displays.

BACKGROUND OF THE ART

Light-emitting diodes (LEDs) are now being used for direct LED displays (where groupings of LEDs essentially comprise a pixel and are used to generate a large image of LED light) as well as the backlight unit for liquid crystal displays (LCDs). Modern displays have become increasingly brighter, with some LCD backlights producing 800-1,500 nits or more. Sometimes, these illumination levels are necessary because the display is being used outdoors, or in other relatively bright areas where the display illumination must compete with other ambient light. In order to produce this level of brightness, LEDs (whether used for backlighting purposes or for direct LED displays) may produce a relatively large amount of heat. Further, displays of the past were primarily designed for operation near room temperature. However, it is now desirable to have displays which are capable of withstanding large surrounding environmental temperature variations. For example, some displays are capable of operating at temperatures as low as −22 F and as high as 113 F or higher. When surrounding temperatures rise, the cooling of the display components can become even more difficult.

Still further, in some situations radiative heat transfer from the sun through a front display surface can also become a source of heat. In some locations 200 Watts or more through such a front display surface is common. Furthermore, the market is demanding larger screen sizes for displays. With increased electronic display screen size and corresponding front display surfaces, more heat will be generated and more heat will be transmitted into the displays.

LED efficiency is typically characterized by a unit of luminance per a unit of power. Sometimes, this is characterized as lumens per Watt (lumens/W). It has been observed, that LED efficiency typically decreases as the temperature of the LED increases. Thus, the hotter an LED gets, the less light is generated per the same amount of power input. In some LED assemblies, there can be substantial temperature variation across the assembly where some areas are cool while others are hot. This is especially seen in large LED assemblies which are exposed to warm ambient temperatures and/or sunlight exposure. Thus, when regions of the LED assembly are warmer than others ('hot spots') the LEDs within these regions will have their luminance affected. To an observer of the display, this variation in luminance can be viewed as non-uniformity across the display. This non-uniformity is undesirable as it can affect the image quality.

SUMMARY OF THE EXEMPLARY EMBODIMENTS

Exemplary embodiments relate to a system and method for controlling the LED power across an LED assembly to account for temperature/luminance variations. The LED assembly may be divided into regions where the temperature of each region is measured. The temperature difference between selected regions may be calculated and compared with a maximum acceptable temperature difference ($\Delta T_{max}$). If two regions differ by more than the maximum acceptable temperature difference, the system can adjust the power sent to some of the regions so that the LED assembly maintains a uniform luminance. This could be accomplished with several different techniques.

A first technique would be to increase the power sent to the hot region. Because the LEDs are at an elevated temperature in the hot region, they now require more power to produce the same amount of luminance as the other regions. Thus, by increasing the power sent to the hot LEDs, their luminance can match that of the cooler regions.

A second technique would be to decrease the power sent to all of the regions that are not running hot. In this technique, the cooler regions could be dimmed so that they would match the reduce luminance that is being generated by the hot region.

A third technique would be to reduce the power sent to the hot region(s) so that it may cool and then perform properly again. It has been found, that the decrease in power sent to the LED region is generally compensated for when the region cools and its efficiency is increased. Thus, once the region cools it now takes less power to generate the same amount of luminance so the decreased amount of power sent to the LEDs is now sufficient and not noticeable to an observer.

The foregoing and other features and advantages will be apparent from the following more detailed description of the particular embodiments of the invention, as illustrated in the accompanying drawings.

BRIEF DESCRIPTION OF THE DRAWINGS

A better understanding of an exemplary embodiment will be obtained from a reading of the following detailed description and the accompanying drawings wherein identical reference characters refer to identical parts and in which.

DETAILED DESCRIPTION

Figure 1:
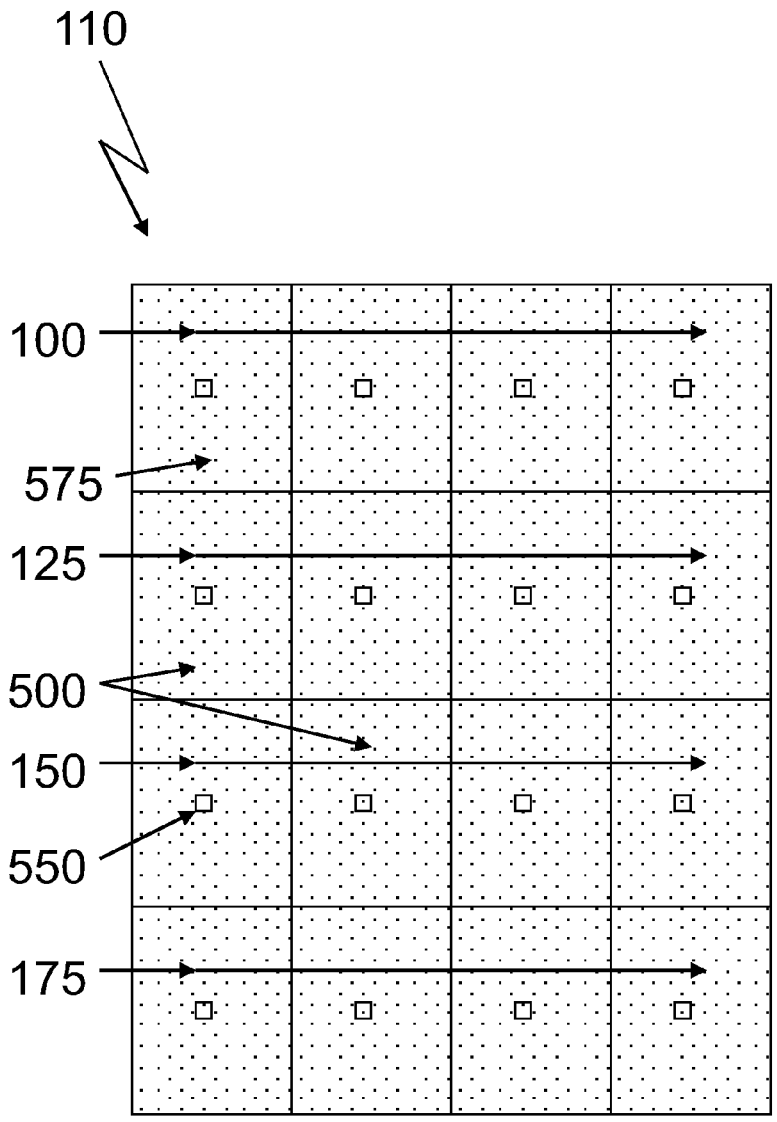
FIG. 1 is a front view of an embodiment of an LED assembly where a plurality of LEDs are divided into a plurality of regions.

FIG. 1 shows a front view of an embodiment of an LED assembly 110 where a plurality of LEDs 575 are divided into a plurality of regions 500. The regions 500 may or may not be physically separated from one another. Thus, in some embodiments each region 500 may be a subassembly or LED tile that is assembled into the overall assembly. In other embodiments, the entire LED assembly 110 may be constructed as one, and the regions 500 are simply divided electrically so that they can be individually controlled. The LEDs may be wired together in any manner necessary for the application. The regions may be divided into several rows where the bottom row 175 is near the bottom of the assembly 110 and the top row 100 is near the top of the assembly 110. This embodiment also shows two additional rows 125 and 150 near the center of the assembly 110. Each region may be equipped with one or more temperature sensing devices 550. Here, a temperature sensing device 550 is preferably placed on the front of the assembly (same side as the LEDs). In some embodiments, the temperature sensing device 550 may be a thermocouple or similar device. The particular embodiment shown in FIG. 1 may be used with a portrait-oriented LCD backlight or a portrait-oriented LED display. The LEDs 575 may be any desired grouping of LEDs, including but not limited to: white LEDs, RGB LEDs, RGBY LEDs, and any other combination. The LEDs may be mounted on the front side of a printed circuit board (PCB). An exemplary embodiment may utilize a metal core printed circuit board.

Figure 2:
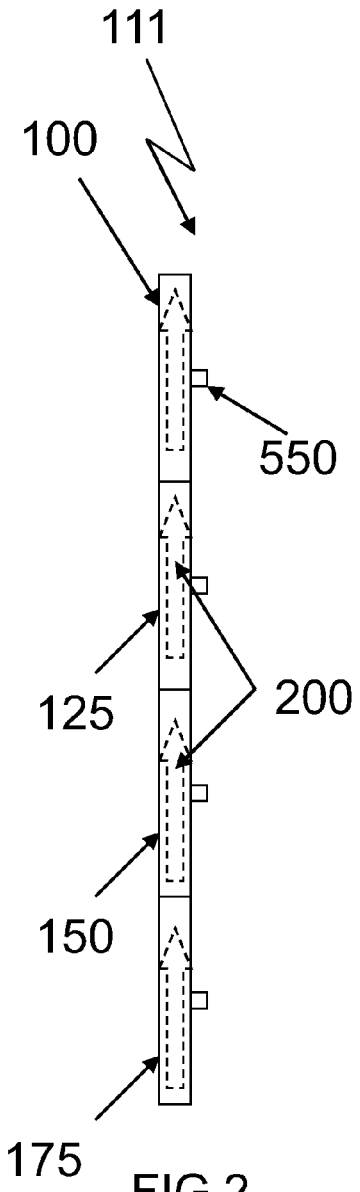
FIG. 2 is another embodiment where the temperature sensing devices are placed on the opposite side (rear) of the LED assembly.

FIG. 2 is a side view of another embodiment where the temperature sensing devices 550 are placed on the opposite side (rear) of the LED assembly 111. The precise placement of the temperature sensing devices 550 may not be important as long as they are in thermal communication with the LEDs 575 (or perhaps the structure that the LEDs are mounted on). In some embodiments, multiple temperature sensing devices 550 may be place throughout the region with their data averaged for an average temperature of the region. Of course, the greater number of regions will provide a greater amount of control over the LED assembly. Therefore, it is preferable to divide the LEDs into as many regions as the design and application will permit so that the greatest amount of control can be exercised over the assembly.

This figure also shows the heat 200 which is known to typically rise up vertically within the assembly. Thus, a typical phenomenon may have heat transferred from the bottom row 175 to the middle rows 150 and 125, continuing up to the top row 100. Thus, in some of these situations, the top row 100 of LED regions may be the hottest and may thus have a luminance which does not match that of the rows below. In these cases, the power sent to each region may be adjusted to provide better luminance uniformity.

Figure 3:
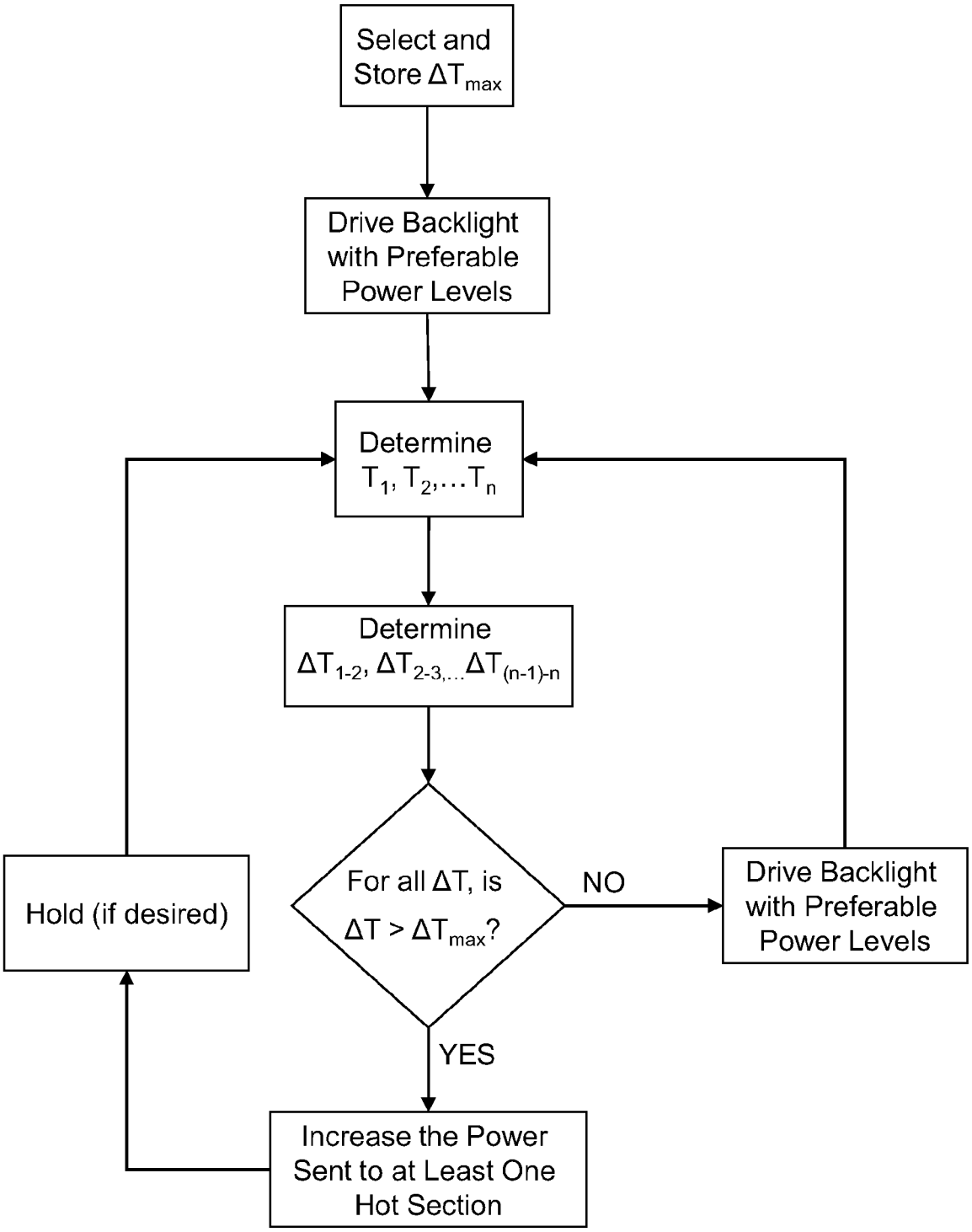
FIG. 3 is a flow-chart providing one method of logic for controlling the system.

FIG. 3 is a flow-chart providing one method of logic for controlling the system. At the start of this embodiment, a preferred maximum acceptable temperature difference ($\Delta T_{max}$) may be selected. $\Delta T_{max}$ may represent the maximum acceptable difference in temperature between two selected regions. $\Delta T_{max}$ may be determined based on a number of different criteria. In some embodiments, $\Delta T_{max}$ may be selected as the maximum temperature difference that has been measure between regions before a noticeable non-uniformity of the LED luminance has been observed. Some embodiments may select $\Delta T_{max}$ such that it is several degrees below where non-uniformity would be noticeable. $\Delta T_{max}$ can be the temperature difference between any two selected regions, which may be selected based on a number of different criteria for a number of different applications.

The regions may be adjacent (either vertically or horizontally). In this embodiment, the system for example may measure the temperature difference between the top row 100 and the adjacent row 125, or the row 150 and the adjacent row 175. Alternatively, the system may measure regions which are separated by one or more regions in between the selected regions (non-adjacent regions). In this type of embodiment, the system for example may measure the temperature difference between the bottom row 175 and the top row 100, or the bottom row 175 and row 125. Some embodiments may select a combination of both adjacent regions as well as regions which are separated by other regions. In these embodiments, there may be multiple values for $\Delta T_{max}$ selected. Thus, there may be a $\Delta T_{max}$ selected for adjacent regions and a second $\Delta T_{max}$ selected for regions which are not adjacent.

Once the value(s) for $\Delta T_{max}$ has been selected, the LED assembly may be driven at the preferable power levels. These levels may be determined based on factory calibration, or data coming from photosensors, or both. During operation, the temperature for each region is measured and stored. The temperature differences ($\Delta T$) between selected regions may then be calculated. The selected regions may be dependant from the selected $\Delta T_{max}$. Thus, if $\Delta T_{max}$ for adjacent regions was selected initially, then the $\Delta T$ for each pair of adjacent regions should be calculated. Alternatively, if $\Delta T_{max}$ for non-adjacent regions was selected initially, then the $\Delta T$ for each non-adjacent regions should be calculated.

Once the $\Delta T$ for each pair of selected regions is calculated, it may be compared with the $\Delta T_{max}$ and if it exceeds (or in some embodiments is equal to) $\Delta T_{max}$ then the hotter of the two selected regions is considered a 'hot region.' If no values for $\Delta T$ exceed the selected $\Delta T_{max}$, then the system may continue to power the LED assembly with the preferred power levels. The system may then return to the top of the loop to re-measure the temperature at each region.

If there are some hot regions, the power sent to the hot region may be increased to account for the reduced efficiency of the LEDs operating at the higher temperature. In this way, any dimming from the reduced efficiency can be accounted for and the luminance of the hot regions can closely match that of the cool regions.

Once the power to the hot region has been increased, the system may optionally hold for a predetermined amount of time to allow the system to adjust (thermally, electrically, etc,) before returning to the top of the loop and re-measuring the temperature of each region.

Figure 4:
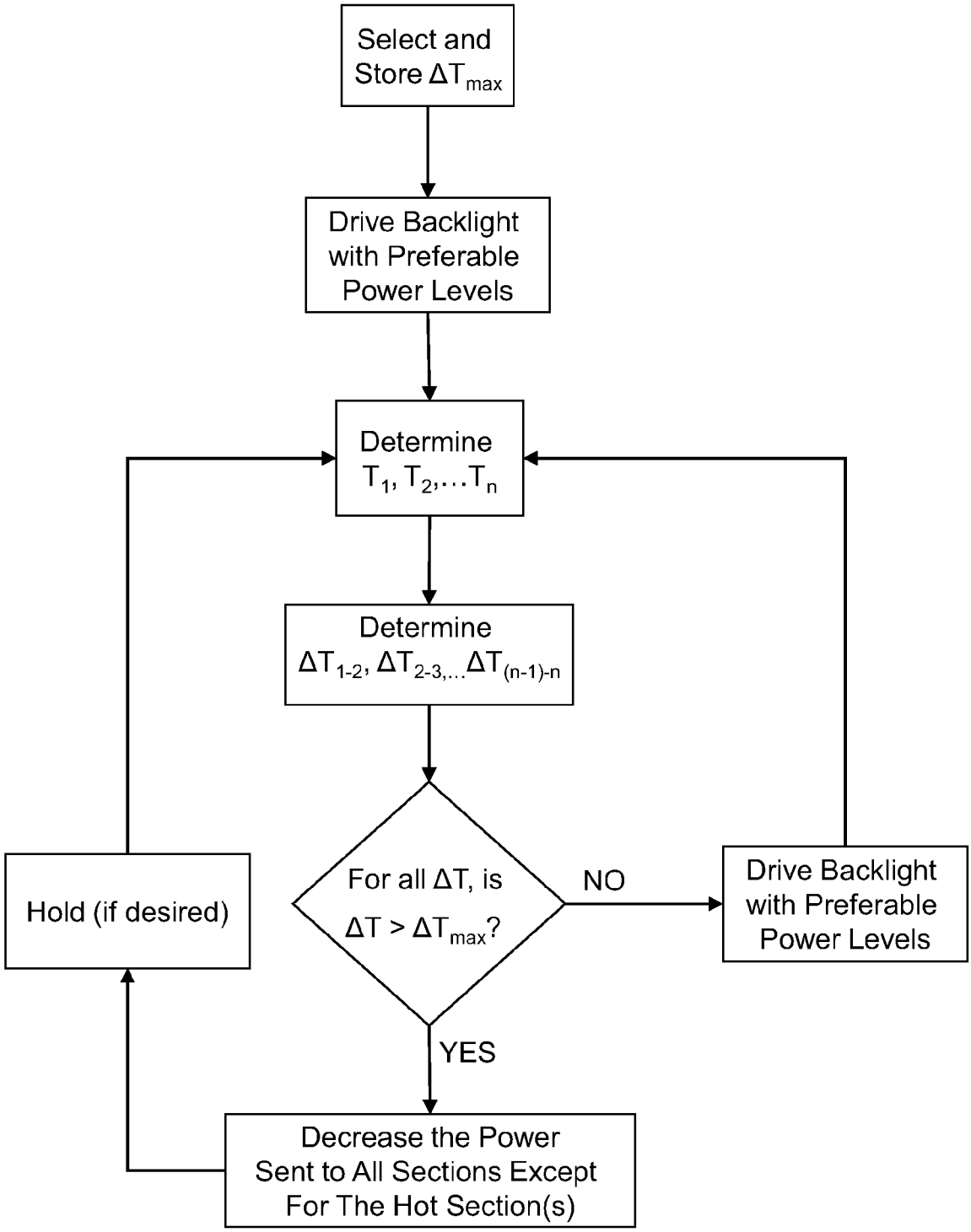
FIG. 4 is a flow-chart providing a second method of logic for controlling the system.

FIG. 4 is a flow-chart providing a second method of logic for controlling the system. This logic is similar to that shown in FIG. 3. However, in this embodiment, if hot regions are found, the power sent to each of the remaining regions (cool or not-hot) is reduced so that the remaining regions of the LED assembly can dim to match the hot region(s).

Figure 5:
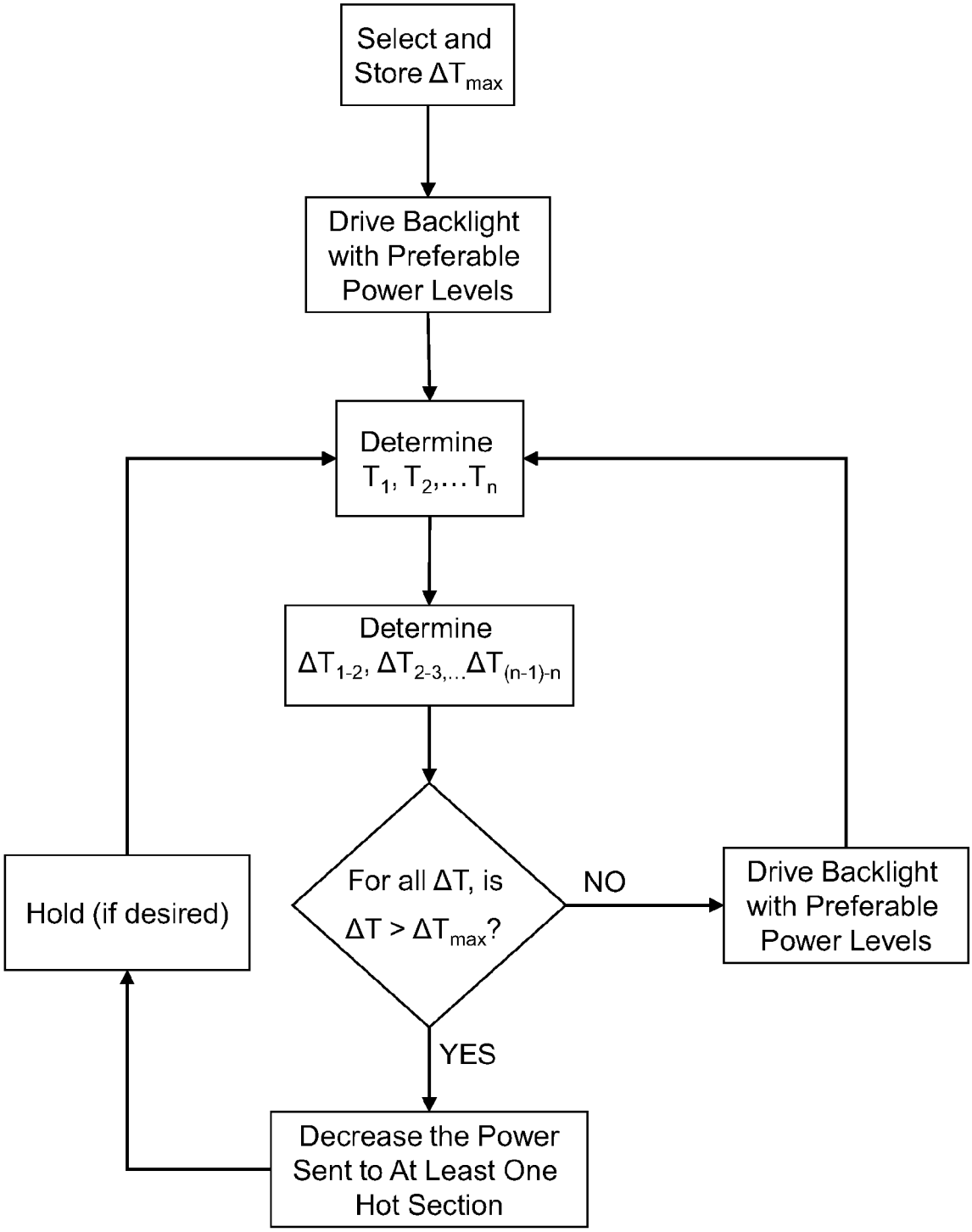
FIG. 5 is a flow-chart providing a third method of logic for controlling the system.

FIG. 5 is a flow-chart providing a third method of logic for controlling the system. This logic is also similar to that shown in FIGS. 3 and 4. However, in this embodiment, if hot regions are found, the power sent to the hot region(s) may be reduced so that it may cool and perform properly again. It has been found, that the decrease in power sent to the LED region may be compensated for when the region cools and its efficiency is increased. Thus, once the region cools it now takes less power to generate the same amount of luminance so the decreased amount of power sent to the LEDs is now sufficient and not noticeable to an observer. This logic may be used depending upon the type of cooling system being employed.

Figure 6:
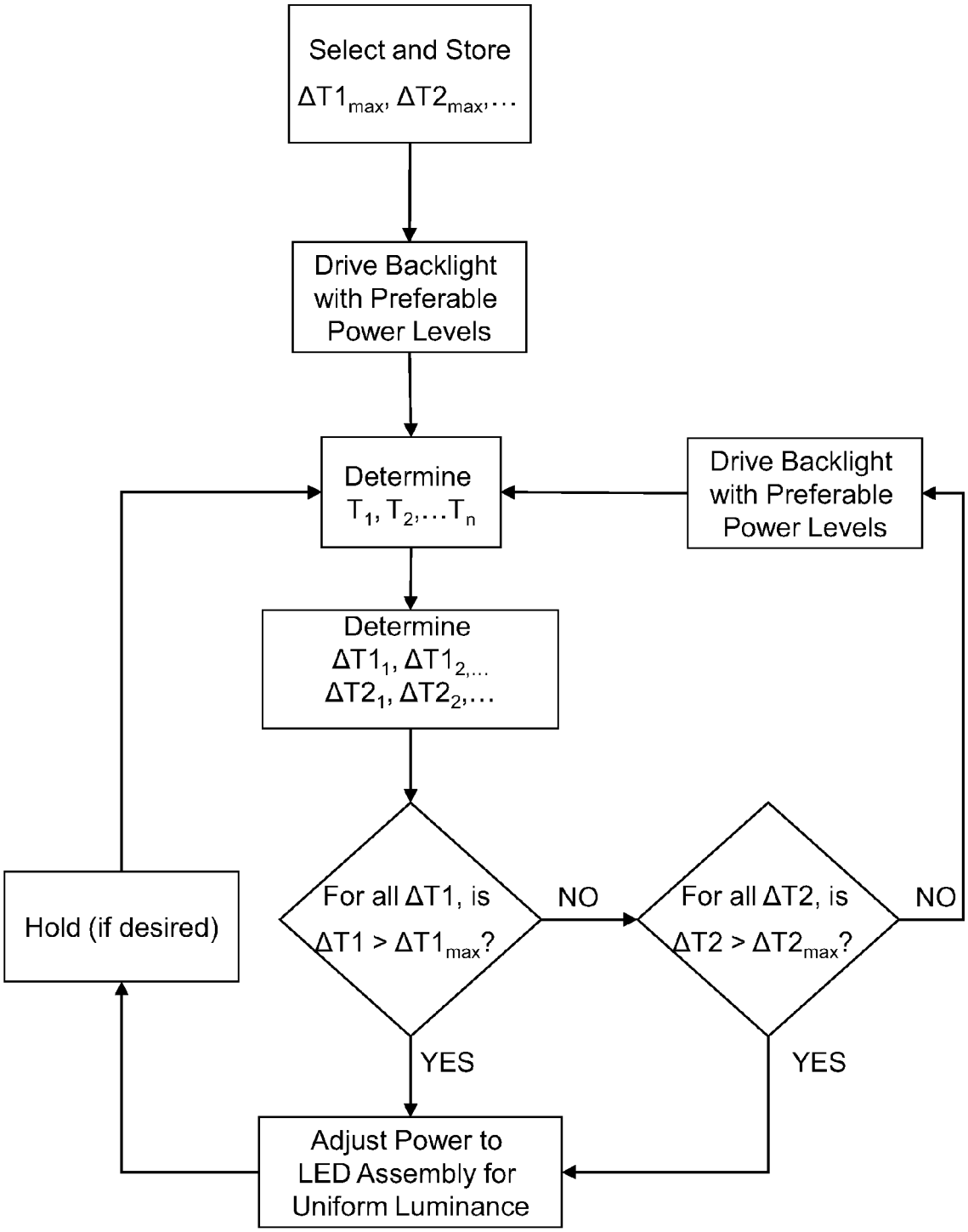
FIG. 6 is a flow-chart providing a method of logic for controlling the system where multiple $\Delta T_{max}$ values may be selected.

FIG. 6 is a flow-chart providing a method of logic for controlling the system where multiple $\Delta T_{max}$ values may be selected. Here, two or more $\Delta T_{max}$ values may be selected so that two or more calculations of $\Delta T$ may be done in order to compare this with the various $\Delta T_{max}$ values. This embodiment may provide an increased level of control over the assembly such that not only can variability between adjacent regions be accounted for, but variability across the entire assembly can also be accounted for.

Figure 7:
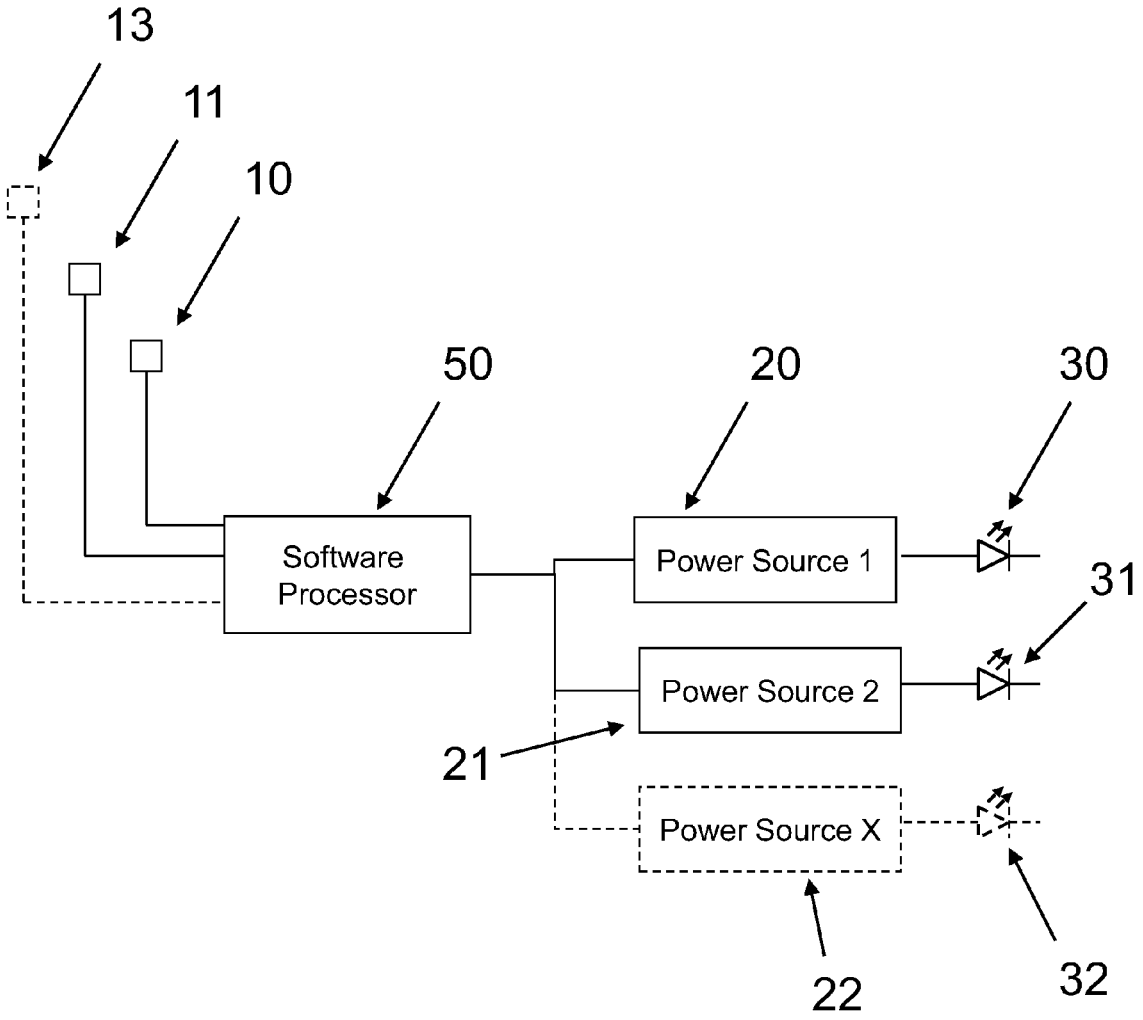
FIG. 7 is an electrical schematic showing the components which may be used when practicing the embodiments described herein.

FIG. 7 is an electrical schematic showing the components which may be used when practicing one of the embodiments described herein. A first 10, second 11, and optional additional 13 temperature sensing devices are shown in electrical communication with a software processor 50. A first 20, second 21, and optional additional 22 power sources may be used to drive a first 30, second 31, and optional additional 32 groups of LEDs. The power sources 20, 21, and 22 may be separate discrete elements (ex. Power modules or power bricks) or may be a singular element containing separately-controlled circuits. The software processor 50 can be any device which is capable of reading/analyzing the data from the temperature sensing devices 10, 11, and 13 and driving the power sources 20, 21, and 22. Some embodiments may use a microprocessor as the software processor 50. Other embodiments may use a CPU as the software processor 50.

It is to be understood that the spirit and scope of the disclosed embodiments provides for the management of luminance variations for many types of displays. By way of example and not by way of limitation, embodiments may be used in conjunction with any of the following: LCD (LED backlit) and/or light emitting diode (LED) displays. Exemplary embodiments may also utilize large (55 inches or more) LED backlit, high definition (1080i or 1080p or greater) liquid crystal displays (LCD). While the embodiments described herein are well suited for outdoor environments, they may also be appropriate for indoor applications (e.g., factory/industrial environments, spas, locker rooms, kitchens, etc.) where thermal stability of the display may be at risk.

Having shown and described preferred embodiments, those skilled in the art will realize that many variations and modifications may be made to affect the described embodiments and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

I claim:

1. A method for controlling luminance variations in LED assemblies having a plurality of LEDs divided into two or more controllable regions, the method comprising:
- driving a first and second LED region at preferred power levels;
- measuring the temperature at the first and second LED regions;
- calculating the temperature difference ($\Delta T_{1-2}$) between the first and second LED regions;
- comparing $\Delta T_{1-2}$ with a predetermined temperature difference $\Delta T$; and
  - increasing power to the LED region having the higher temperature measurement if $\Delta T_{1-2}$ is greater than $\Delta T$ or
  - continuing with preferred power levels if $\Delta T_{1-2}$ is less than $\Delta T$.

2. The method of claim 1 wherein:
the first and second LED regions are arranged vertically.

3. The method of claim 1 wherein:
the steps are performed by a microprocessor.

4. The method of claim 1 wherein:
the steps are performed by a CPU.

5. The method of claim 1 further comprising the steps of:
- driving a third LED region at a preferred power level;
- measuring the temperature at the third LED region;
- calculating $\Delta T_{1-3}$ between the first and third LED regions and $\Delta T_{2-3}$ between the second and third LED regions;
- comparing $\Delta T_{1-3}$ and $\Delta T_{2-3}$ with a predetermined temperature difference $\Delta T$; and
  - increasing power to the LED region having the highest temperature measurement if either $\Delta T_{1-3}$ or $\Delta T_{2-3}$ is greater than $\Delta T$ or
  - continuing with preferred power levels if $\Delta T_{1-3}$ and $\Delta T_{2-3}$ are less than $\Delta T$.

6. The method of claim 5 wherein:
the first, second, and third LED regions are arranged vertically.

7. A method for controlling luminance variations in LED assemblies having a plurality of LEDs divided into two or more controllable regions, the method comprising:
- driving a first and second LED region at preferred power levels;
- measuring the temperature at the first and second LED regions;
- calculating the temperature difference ($\Delta T_{1-2}$) between the first and second LED regions;
- comparing $\Delta T_{1-2}$ with a predetermined temperature difference $\Delta T$; and
  - decrease power to the LED region having the lower temperature measurement if $\Delta T_{1-2}$ is greater than $\Delta T$ or
  - continue with preferred power levels if $\Delta T_{1-2}$ is less than $\Delta T$.

8. The method of claim 7 wherein:
the first and second LED regions are arranged vertically.

9. The method of claim 7 wherein:
the steps are performed by a microprocessor.

10. The method of claim 7 wherein:
the steps are performed by a CPU.

11. The method of claim 7 further comprising the steps of:
- driving a third LED region at a preferred power level;
- measuring the temperature at the third LED region;
- calculating $\Delta T_{1-3}$ between the first and third LED regions and $\Delta T_{2-3}$ between the second and third LED regions;
- comparing $\Delta T_{1-3}$ and $\Delta T_{2-3}$ with a predetermined temperature difference $\Delta T$; and
  - decreasing power to all LED regions except for the region having the lowest temperature measurement if either $\Delta T_{1-3}$ or $\Delta T_{2-3}$ is greater than $\Delta T$ or
  - continuing with preferred power levels if $\Delta T_{1-3}$ and $\Delta T_{2-3}$ are less than $\Delta T$.

12. The method of claim 11 wherein:
the first, second, and third LED regions are arranged vertically.

13. A system for controlling luminance variations across an LED assembly comprising:
- a first plurality of LEDs in electronic communication with a first power source;
- a first temperature sensing device placed to measure the temperature (T1) of the first plurality of LEDs;
- a second plurality of LEDs in electronic communication with a second power source;
- a second temperature sensing device placed to measure the temperature (T2) of the second plurality of LEDs;
- a processor in electrical communication with the power sources and temperature sensing devices, and adapted to:
  - drive the first and second plurality of LEDs at preferred power levels;

calculate the difference ($\Delta T_{1-2}$) between T1 and T2;

compare $\Delta T_{1-2}$ with a predetermined temperature difference $\Delta T$; and increase power to the plurality of LEDs having the higher temperature measurement if $\Delta T_{1-2}$ is greater than $\Delta T$ or continue with preferred power levels if $\Delta T_{1-2}$ is less than $\Delta T$.

14. The system of claim 13 wherein:

the first and second LED regions are arranged vertically.

15. The system of claim 13 further comprising:

a third plurality of LEDs in electronic communication with a third power source;

a third temperature sensing device placed to measure the temperature (T3) of the third plurality of LEDs;

wherein the processor in electrical communication with the third power source and third temperature sensing device, and further adapted to:

drive the third plurality of LEDs at a preferred power level;

calculate the difference $\Delta T_{1-3}$ between T1 and T3 and $\Delta T_{2-3}$ between T2 and T3;

compare $\Delta T_{1-3}$ and $\Delta T_{2-3}$ with a predetermined temperature difference $\Delta T$; and increase power to the plurality of LEDs having the highest temperature measurement if either $\Delta T_{1-3}$ or $\Delta T_{2-3}$ is greater than $\Delta T$ or continue with preferred power levels if $\Delta T_{1-3}$ and $\Delta T_{2-3}$ are less than $\Delta T$.

16. The system of claim 15 wherein:

the first, second, and third LED regions are arranged vertically.

17. An LED assembly comprising:

a first plurality of LEDs in electronic communication with a first power source;

a first temperature sensing device placed to measure the temperature (T1) of the first plurality of LEDs;

a second plurality of LEDs in electronic communication with a second power source, the LEDs placed above the first plurality of LEDs;

a second temperature sensing device placed to measure the temperature (T2) of the second plurality of LEDs;

a third plurality of LEDs in electronic communication with a third power source, the LEDs placed above the second plurality of LEDs;

a third temperature sensing device placed to measure the temperature (T3) of the third plurality of LEDs;

a processor in electrical communication with the power sources and temperature sensing devices, and adapted to:

drive the first, second, and third plurality of LEDs at preferred power levels;

calculate the difference ($\Delta T_{1-2}$) between T1 and T2, $\Delta T_{1-3}$ between T1 and T3, and $\Delta T_{2-3}$ between T2 and T3;

compare $\Delta T_{1-2}$, $\Delta T_{1-3}$, and $\Delta T_{2-3}$ with a predetermined temperature difference $\Delta T$; and increase power to the plurality of LEDs having the highest temperature measurement if either $\Delta T_{1-3}$, $\Delta T_{2-3}$, or $\Delta T_{1-2}$ is greater than $\Delta T$ or continue with preferred power levels if $\Delta T_{1-3}$, $\Delta T_{2-3}$, and $\Delta T_{1-2}$ are less than $\Delta T$.

18. The system of claim 17 further comprising:

a printed circuit board having a front and back surface where the LEDs and temperature sensing devices are mounted on the front surface.

19. The system of claim 17 further comprising:

a metal core printed circuit board having a front and back surface where the LEDs are mounted on the front surface and the temperature sensing devices are mounted on the back surface.

* * * * *